United States Patent [19]

Swan

[11] 4,348,271

[45] Sep. 7, 1982

[54] CATALYTIC REFORMING PROCESS

[75] Inventor: George A. Swan, Baton Rouge, La.

[73] Assignee: Exxon Research & Engineering Co., Florham Park, N.J.

[21] Appl. No.: 283,167

[22] Filed: Jul. 14, 1981

[51] Int. Cl.[3] ..... C10G 45/00

[52] U.S. Cl. ..... 208/89; 208/65; 208/66; 208/138

[58] Field of Search ..... 208/65, 66, 89

[56] References Cited

U.S. PATENT DOCUMENTS

| | | | |
|---|---|---|---|
| 2,880,161 | 3/1959 | Moore et al. | 208/65 |
| 2,902,434 | 9/1959 | Burton et al. | 208/134 |
| 3,556,986 | 1/1971 | Beck et al. | 208/134 |

*Primary Examiner*—Curtis R. Davis

*Attorney, Agent, or Firm*—Llewellyn A. Proctor

[57] ABSTRACT

A process, or procedure, for the start-up of reforming units, particularly those employing highly active sulfur-sensitive polymetallic, promoted noble metal containing catalysts. On start-up of a reforming unit, a sulfur-containing naphtha feed is fed at reforming conditions over a platinum-catalyst containing lead reactor of a series while bypassing subsequent reactors of the series, the product therefrom is separated into hydrogen-containing gas and $C_5$+ liquid fractions, the hydrogen-containing gas fraction is desulfurized and dried and recycled to the platinum-catalyst containing lead reactor and, after sufficient hydrogen has been generated for operation of a Hydrofiner which is used to hydrodesulfurize the naphtha feed for the reformer, product from the platinum-catalyst containing lead reactor is fed to subsequent reactors of the series which contain the more sulfur-sensitive catalysts.

10 Claims, 1 Drawing Figure

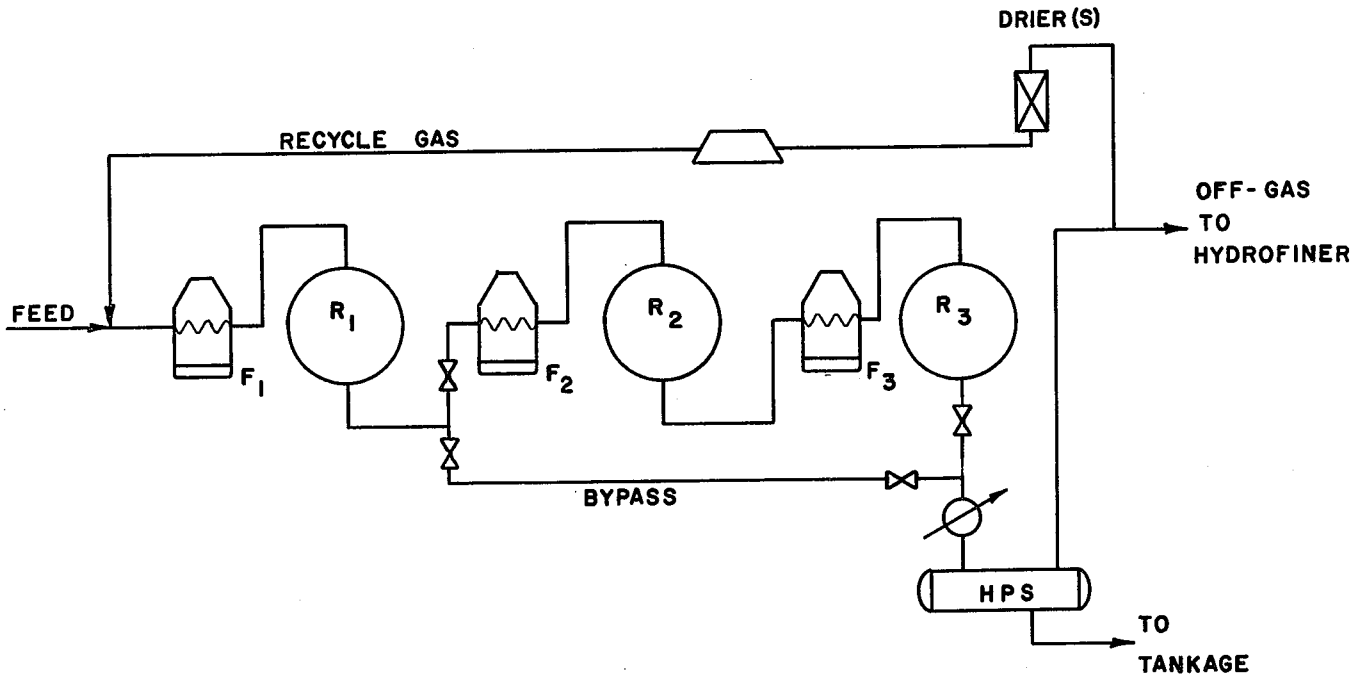
FIGURE

CATALYTIC REFORMING PROCESS

BACKGROUND OF THE INVENTION AND PRIOR ART

Catalytic reforming, or hydroforming, is a well established industrial process employed by the petroleum industry for improving the octane quality of naphthas or straight run gasolines. In reforming, a multi-functional catalyst is employed which contains a metal hydrogenation-dehydrogenation (hydrogen transfer) component, or components, substantially atomically dispersed upon the surface of a porous, inorganic oxide support, notably alumina. Noble metal catalysts, notably of the platinum type, are currently employed, reforming being defined as the total effect of the molecular changes, or hydrocarbon reactions, produced by dehydrogenation of cyclohexanes and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst.

Platinum has been widely commercially used in recent years in the production of reforming catalysts, and platinum-on-alumina catalysts have been commercially employed in refineries for the last few decades. In the last decade, additional metallic components have been added to platinum as promoters to further improve the activity or selectivity, or both, of the basic platinum catalyst, e.g., iridium, rhenium, tin, and the like. Platinum-rhenium catalysts, by way of example, possess admirable selectively as contrasted with platinum catalysts, selectivity being defined as the ability of the catalyst to produce high yields of $C_5+$ liquid products with concurrent low production of normally gaseous hydrocarbons, i.e., methane and other gaseous hydrocarbons, and coke.

Reforming reactions are both endothermic and exothermic, the former predominating, particularly in the early stages of reforming with the latter predominating in the latter stages of reforming. In view thereof, it has become the practice to employ a plurality of adiabatic fixed-bed reactors in series with provision for interstage heating of the feed to each of the several reactors. There are two major types of reforming. In semi-regenerative reforming, the entire unit is operated by gradually and progressively increasing the temperature to compensate for deactivation of the catalyst caused by the coke deposition, until finally the entire unit is shut down for regeneration, and reactivation, of the catalyst. In cyclic reforming, the reactors are individually isolated, or in effect swung out of line by various piping arrangements, the catalyst is regenerated to remove the coke deposits, and then reactiviated while the other reactors of the series remain on stream. A "swing reactor" temporarily replaces a reactor which is removed from the series for regeneration and reactivation of the catalyst, and is then put back in series. In either type of reforming, hydrogen is produced in net yield, the product being separated into a $C_5+$ liquid product, e.g., a $C_5$/430° F. product, and a hydrogen rich gas a portion of which is recycled to the several reactors of the process unit. In most refineries, hydrogen from the reforming operation is also required for operation of a Hydrofiner; proper operation of the Hydrofiner being essential for removing sulfur from the feed to the reforming unit.

Essentially all petroleum naphtha feeds contain sulfur, a well known catalyst poison which can gradually accumulate upon and poison the catalyst. Most of the sulfur, because of this adverse effect, is generally removed from feed naphthas, particularly by Hydrofining, or hydrogen treating. In use of the more recently developed multi-metallic platinum catalysts wherein an additional metal, or metals, hydrogenation-dehydrogenation component is added as a promoter to the platinum, it has become essential to reduce the feed sulfur to only a few parts, per million parts by weight of feed (ppm). For example, in the use of platinum-rhenium catalysts it is generally necessary to reduce the sulfur concentration of the feed well below about 10 ppm, and preferably well below about 2 ppm, to avoid excessive loss of catalyst activity and $C_5+$ liquid yield. The role of sulfur on the catalyst presents somewhat of an anomaly because the presence of sulfur in the feed can adversely affect the activity of the catalyst and reduce liquid yield; and yet, sulfiding of the polymetallic catalyst species, which is a part of the catalyst reactivation procedure, has been found essential to suppress excessive hydrogenolysis which is particularly manifest when a reactor is first put on stream after regeneration and reactivation of the catalyst. Excessive hydrogenolysis caused by use of these highly active catalysts can not only produce acute losses in $C_5+$ liquid yield through increased gas production, but the severe exotherms which accompany operation in a hydrogenolysis mode can seriously damage the catalyst, reactor, and auxiliary equipment.

In semi-regenerative reforming, for example, it has been found that when the reactors of a unit which contain fresh, or regenerated, reactivated highly active rhenium promoted platinum catalysts are put back onstream, the start-up period is characterized by an initial loss of catalyst activity and loss of $C_5+$ liquid yield. The same phenomenon is observed in cyclic reforming. When a platinum-rhenium catalyst loaded reactor is reinserted in the multiple reactor series of the unit, albeit it contains a fresh catalyst, or a regenerated, reactivated, sulfided catalyst, there occurs an initial upset period when the catalyst activity and $C_5+$ liquid yield of the unit is reduced. It has been observed that this effect is first noted in the reactor immediately downstream of the swing reactor which when first put onstream contains a freshly sulfided catalyst. A quantity of sulfur is released when the freshly sulfided catalyst is contacted with the feed, the sulfur wave travelling downstream from one reactor to the next of the series. Concurrent with the sulfur wave there results a loss in $C_5+$ liquid yield which, like a wave, also progresses in seratim from one reactor of the series to the next until finally the $C_5+$ liquid yield loss is observed throughout the unit. Over a sufficiently long period after the initial decline in $C_5+$ liquid yield loss, the $C_5+$ liquid yield in the several reactors of the unit, and consequently the overall performance of the unit, gradually improves, though often the improvement is not sufficient to return each of the reactors of the unit, or unit as a whole, to its original higher performance level.

It is desirable, because of this phenomenon, to avoid the use of high sulfur feeds, particularly during start-up. Quite obviously, however, this is not always possible; and all too often it is simply infeasible to use a sweet feed. It is often necessary to put the unit on-stream with a high sulfur feed (e.g., one which contains 25–200 ppm sulfur) until sufficient hydrogen is generated to operate the naphtha Hydrofiner. In employing polymetallic catalysts, e.g., platinum-rhenium catalysts, this presents a significant problem, since high hydrogen sulfide following oil-in results in severe catalyst activity and $C_5+$ liquid yield losses. The consequences of this adverse start-up have long range effects, and the losses occasioned on start-up are only partially reversed even after the feed sulfur has dropped to an acceptable concentration (<2 ppm) after the Hydrofiner is operating satisfactorily. Coke formed early in the run on a highly active catalyst in a high sulfur environment is particularly detrimental. Purging hydrogen sulfide from the system is a slow process, even with recycle gas driers having good sulfur capacity.

It is, accordingly, the primary object of this invention to provide a new and improved process which will obviate these and other disadvantages of the present start-up procedures for reforming units, particularly those employing highly active polymetallics, or promoted noble metal containing catalysts.

A specific object is to provide a new and novel operating procedure for reforming units, notably one which will effectively suppress sulfur release and the normally expected initial period of $C_5+$ liquid yield decline which occurs with metal promoted platinum catalysts, particularly rhenium promoted platinum catalysts.

These objects and others are achieved in accordance with the present invention embodying an improved process wherein, on start-up of a reforming unit, a sulfur-containing naphtha feed is fed at reforming conditions over a platinum-catalyst containing lead reactor of a series while bypassing subsequent reactors of the series, the product therefrom is separated into hydrogen-containing gas and $C_5+$ liquid fractions, the hydrogen-containing gas fraction is desulfurized and dried and recycled to the platinum-catalyst containing lead reactor and, after sufficient hydrogen has been generated for operation of the Hydrofiner, product from the platinum-catalyst containing lead reactor is fed to subsequent reactors of the series which contain more sulfur-sensitive catalysts, notably polymetallic, or metal promoted platinum catalysts.

In other words, in accordance with this invention, during start-up with a relatively high sulfur feed, only the platinum catalyst of the lead reactor is contacted with high sulfur feed, and succeeding reactors to which the product of the lead reactor is normally fed are bypassed. Since the platinum catalyst is much less sulfur sensitive than metal promoted platinum catalysts, the lead reactor catalytically reforms the feed to produce an admixture of hydrogen-containing gases and $C_5+$ liquids. A hydrogen enriched gas is separated from the admixture and passed, in whole or in part, to the Hydrofiner. Hydrogen is used in the Hydrofiner to desulfurize the sulfur-containing feed to a preselected concentration, depending on the requirements of the reforming unit. The concentration of sulfur is reduced in the Hydrofiner feed, with the consequence that the sulfur concentration in the feed to the lead reactor of the reforming unit is also reduced, sulfur being purged from the platinum catalyst. When the hydrogen sulfide concentration in the output gas product from the lead reactor is reduced below about 10 parts per million by volume, vppm, preferably below about 5 vppm, then the downstream reactors of the unit are brought on stream at reforming conditions to produce reformate of the desired octane. The $C_5+$ liquid originally reformed in the lead reactor, if desired, can be further reformed in the series of reactors to further improve the octane, or blended in with the total product.

These features and others will be better understood by reference to the following more detailed description of the invention, and to the drawing to which reference is made.

In the drawing:

The FIGURE depicts, by means of a simplified flow diagram, a preferred reforming unit inclusive of multiple on-stream reactors.

Referring to the FIGURE, generally, there is described a reforming unit comprised of a multi-reactor system, inclusive of Reactors $R_1$, $R_2$ and $R_3$, each of which are connected in series and preceded by a heater or preheat furnace, $F_1$, $F_2$ and $F_3$, respectively. Pumps, compressors and other auxiliary equipment are omitted for clarity. A hydrocarbon feed, or naphtha, can be serially passed with hydrogen through $F_1R_1$, $F_2R_2$ and $F_3R_3$, or the feed and hydrogen can be serially passed through $F_1R_1$ while bypassing $F_2R_2$ and $F_3R_3$, with the products from the reactions being passed to a high pressure separator HPS. Each reactor can be packed with fixed beds of an appropriate catalyst; i.e., $R_1$ can be filled with a platinum-on-alumina catalyst and $R_2$ and $R_3$ filled with the more sulfur sensitive polymetallic catalysts, suitably platinum-rhenium-alumina catalysts. A portion of the hydrogen-rich make gas can be taken from the top of the high pressure separator HPS and, after passage through a make gas compressor, sent to a Hydrofiner (not shown), and another portion recycled through gas driers to the lead furnace and reactor $F_1R_1$. $C_5+$ liquids from the bottom of high pressure separator HPS are sent to a stabilizer, or to tankage.

At start-up of the unit, the bypass is opened, and the furnaces and reactors $F_2R_2$ and $F_3R_3$ are shut off from $F_1R_1$, feed being passed with hydrogen, to the extent that hydrogen is available for start-up, directly to $F_1R_1$ with the product of $R_1$ being sent directly to the high pressure separator HPS. Low octane, off-specification reformate (e.g., 65–70 RON) produced during a brief bypass period (e.g., 12–24 hours) is sent from the high pressure separator HPS to tankage for later processing, or diverted to alternate uses in the refinery. A portion of the off-gas from the high pressure separator HPS is recycled to $F_1R_1$, and a portion of the gas is passed to the Hydrofiner (not shown). After the unit has lined out and is generating sufficient hydrogen for operation of the Hydrofiner, and the reforming unit, the bypass line is then closed off and the product of the lead reactor $R_1$ is passed serially through the furnaces and reactors $F_2R_2$ and $F_3R_3$, respectively. Furnaces $F_2$ and $F_3$ are fired, and the coil outlet temperatures increased to operating specifications. Substantially all, or a major portion of the moisture and sulfur are scrubbed and removed from the recycle gas by the recycle gas drier to maintain a dry, low-sulfur system.

The invention, and its principle of operation, will be more fully understood by reference to the following example, and comparative data provided by computer simulations from actual operations, which characterizes a preferred mode of operation.

EXAMPLE

A semi-regenerative reformer unit (3 reactor configuration) is designed to operate at 350 psig and 3000

SCF/B recycle gas rate with 97 RONC product octane target on a paraffinic Arabian virgin naphtha with the following properties:

| API Gravity = 59.7<br>RONC = 49.0<br>ASTM Distillation | |
|---|---|
| IBP °F. | 181 |
| 5% | 196 |
| 30% | 218 |
| 50% | 241 |
| 70% | 269 |
| 90% | 310 |
| 95% | 328 |
| FBP °F. | 350 |
| Paraffins, vol % | 58.5 |
| Naphthenes, vol % | 32.2 |
| Aromatics, vol % | 9.3 |

A naphtha Hydrofiner upstream of the reformer unit operates at 400 psig and 500 SCF/B treat gas rate to desulfurize the feed such that only about 0.5 wppm sulfur remains. However, start-up and operation of the Hydrofiner are contingent upon obtaining a supply of treat gas from the reformer unit. Usually a partially desulfurized naphtha (blend of Hydrofined and un-Hydrofined naphthas) is available for the start-up. In this example, the feed contains 25 wppm sulfur.

Two cases are considered:

Case I: Operation with 0.3% Pt/0.3% Re catalyst in all reactors.

Case II: Operation with 0.3% Pt catalyst in the lead reactor, $R_1$, only, followed by 0.3% Pt/0.3% Re catalyst in subsequent reactors, i.e., $R_2$ and $R_3$.

High feed sulfur results in drastic activity loss in Case I, which stabalizes when the Hydrofiner starts up and feed sulfur drops to less than wppm. In Case II, reactors $R_2$ and $R_3$, which contain the platinum-rhenium catalyst are bypassed during start-up. Reactor $R_1$ operates at equivilent isothermal temperatures of 840°–860° F. and generates about 500 SCF/B hydrogen at these conditions, which is adequate for Hydrofiner start-up When feed sulfur decreases to less than 1 wppm, the $H_2S$ in the recycle gas is preferably less than 5 vppm at the drier inlet. The bypass line is then closed and reactors $R_2$ and $R_3$ are put into service. Case II offers a 45% increase in run length compared with Case I, as shown in the table:

| CASE | EXTRAPOLATED INITIAL ACTIVITY | DAYS TO REACH ACTIVITY = 30 |
|---|---|---|
| I | 51 | 80 |
| II | 64 | 117 |

These data show that the performance of the unit operated in accordance with the process of this invention is far superior to that wherein all of the reactors are put on-stream ab initio on start-up of the unit. The short term loss as a result of producing off-spec reformate is more than compensated for by the higher catalyst activity and $C_5$+ liquid yields over the length of an operating cycle.

This invention is applicable to the operation of both semi-regenerative and cyclic reforming units, or hybrid reforming units which feature both types of operations. While the preferred catalyst used in the lead reactor is a supported platinum catalyst, the catalyst of the lead reactor can also be metal promoted, provided that its sulfur sensitivity is not significantly increased by the added promoter metal. However, since coke build up is relatively slow with naphthene dehydrogenation reactions, the principal reaction in the lead reactor, the unpromoted platinum catalyst is adequate, and also provides a measure of protection in the event of a Hydrofiner upset.

Catalysts suitable for the practice of this invention for use in reactors following the lead reactor are constituted of a Group VIII noble metal, or platinum group metal, or contain a hydrogenation-dehydrogenation component constituted of a platinum group metal in admixture with one or more additional platinum group or non-platinum group metallic components such as germanium, gallium, tin, iridium, rhenium, tungsten, and the like. A preferred type of catalyst contains the hydrogenation-dehydrogenation component in absolute concentration ranging from about 0.01 to about 3 wt. %, and preferably from about 0.5 to about 1.0 wt. %, based on the total catalyst composition. The metal promoter component is also added in absolute concentrations ranging from about 0.01 to about 3 wt. %, preferably from about 0.5 to about 1.0 wt. %. In addition, such catalysts also usually contain an acid component, preferably halogen, particularly chlorine or fluorine, in concentration ranging from about 0.1 to about 3 wt. %, and preferably from about 0.1 to about 3 wt. %. The hydrogenation-dehydrogenation components are composited with an inorganic oxide support, such as silica, silica-alumina, magnesia, thoria, zirconia, or the like, and preferably alumina.

Rhenium promoted platinum catalysts are preferred for use in all but the lead reactor of the series. In one of its aspects, optimum utilization of rhenium-promoted platinum catalysts is obtained by providing the reactors, subsequent to the first reactor of the series, with rhenium in concentration adequate to provide an atomic ratio of rhenium:platinum ranging from about 0.1:1 to about 1:1, preferably from about 0.5:1 to about 1:1. The last reactor of the series may be provided with rhenium in concentration adequate to provide an atomic ratio of rhenium:platinum above about 1.5:1, preferably from about 1.5:1 to about 4:1, and higher, and more preferably from about 2:1 to about 3:1.

The catalyst employed in accordance with this invention is necessarily constituted of composite particles which contain, besides a carrier or support material, a hydrogenation-dehydrogenation component, or components, a halide component and, preferably, the catalyst is sulfided. The support material is constituted of a porous, refractory inorganic oxide, particularly alumina. The support can contain, e.g., one or more of alumina, bentonite, clay, diatomaceous earth, zeolite, silica, activated carbon, magnesia, zirconia, thoria, and the like; though the most preferred support is alumina to which, if desired, can be added a suitable amount of other refractory carrier materials such as silica, zirconia, magnesia, titania, etc., usually in a range of about 1 to 20 percent, based on the weight of the support. A preferred support for the practice of the present invention is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30 to 300 A.

The metal hydrogenation-dehydrogenation component can be composited with or otherwise intimately associated with the porous inorganic oxide support or carrier by various techniques known to the art such as ion-exchange, coprecipitation with the alumina in the sol or gel form, and the like. For example, the catalyst composite can be formed by adding together suitable reagents such as a salt of platinum and ammonium hydroxide or carbonate, and a salt of aluminum such as aluminum chloride or aluminum sulfate to form aluminum hydroxide. The aluminum hydroxide containing the salts of platinum can then be heated, dried, formed into pellets or extruded, and then calcined in nitrogen or other non-agglomerating atmosphere. The metal hydrogenation components can also be added to the catalyst by impregnation, typically via an "incipient wetness" technique which requires a minimum of solution so that the total solution is absorbed, initially or after some evaporation.

It is preferred to deposit the platinum, or platinum and rhenium metals, or other metal or metals used as promoters, if any, on a previously pilled, pelleted, extruded, or sieved particulate support material by the impregnation method. Pursuant to the impregnation method, porous refractory inorganic oxides in dry or solvated state are contacted, either alone or admixed, or otherwise incorporated with a metal or metals-containing solution, or solutions, and thereby impregnated by either the "incipient wetness" technique, or a technique embodying absorption from a dilute or concentrated solution, or solutions, with subsequent filtration or evaporation to effect total uptake of the metallic components.

Platinum in absolute amount, is usually supported on the carrier within the range of from about 0.01 to 3 percent, preferably from about 0.05 to 1 percent, based on the weight of the catalyst (dry basis). Rhenium, in absolute amount, is also usually supported on the carrier in concentration ranging from about 0.1 to about 3 percent, preferably from about 0.5 to about 1 percent, based on the weight of the catalyst (dry basis). The absolute concentration of each of use in reactors other than the lead reactor, of course, is preselected to provide the desired atomic ratio of rhenium:platinum for a respective reactor of the unit, as heretofore expressed. In the final reactor, preferably, the rhenium is provided in major amount relative to the platinum whereas, in contrast, in reactors other than the lead reactor the rhenium is provided in minor amount, or no more than about an equal amount, relative to the platinum, based on the atomic weight of these metals, one with respect to the other. In compositing the metals with the carrier, essentially any soluble compound can be used, but a soluble compound which can be easily subjected to thermal decomposition and reduction is preferred, for example, inorganic salts such as halide, nitrate, inorganic complex compounds, or organic salts such as the complex salt of acetylacetone, amine salt, and the like. Where, e.g., platinum is to be deposited on the carrier, platinum chloride, platinum nitrate, chloroplatinic acid, ammonium chloroplatinate, potassium chloroplatinate, platinum polyamine, platinum acetylacetonate, and the like, are preferably used. A promoter metal, is added in concentration ranging from about 0.01 to 3 percent, preferably from about 0.05 to about 1 percent, based on the weight of the catalyst.

To enhance catalyst performance in reforming operations, it is also required to add a halogen component to the catalysts, fluorine and chlorine being preferred halogen components. The halogen is contained on the catalyst within the range of 0.1 to 3 percent, preferably within the range of about 1 to about 1.5 percent, based on the weight of the catalyst. When using chlorine as a halogen component, it is added to the catalyst within the range of about 0.2 to 2 percent, preferably within the range of about 1 to 1.5 percent, based on the weight of the catalyst. The introduction of halogen into the catalyst can be carried out by any method at any time. It can be added to the catalyst during catalyst preparation, for example, prior to, following or simultaneously with the incorporation of the metal hydrogenation-dehydrogenation component, or components. It can also be introduced by contacting a carrier material in a vapor phase or liquid phase with a halogen compound such as hydrogen fluoride, hydrogen chloride, ammonium chloride, or the like.

The catalyst is dried by heating at a temperature above about 80° F., preferably between about 150° F. and 300° F., in the presence of nitrogen or oxygen, or both, in an air stream or under vacuum. The catalyst is calcined at a temperature between about 500° F. to 1200° F., preferably about 500° F. to 1000° F., either in the presence of oxygen in an air stream or in the presence of an inert gas such as nitrogen.

Sulfur is a highly preferred component of the catalysts, the sulfur content for the catalyst generally ranging to about 0.2 percent, preferably from about 0.05 percent to about 0.15 percent, based on the weight of the catalyst (dry basis). The sulfur can be added to the catalyst by conventional methods, suitably by breakthrough sulfiding of a bed of the catalyst with a sulfur-containing gaseous stream, e.g., hydrogen sulfide in hydrogen, performed at temperature ranging from about 350° F. to about 1050° F. and at pressures ranging from about 1 to about 40 atmospheres for the time necessary to achieve breakthrough, or the desired sulfur level.

The feed or charge stock can be a virgin naphtha, cracked naphtha, a naphtha from a coal liquefaction process, a shale oil process, a Fischer-Tropsch naptha, or the like. Such feeds can contain sulfur or nitrogen, or both, at fairly high levels. Typical feeds are those hydrocarbons containing from about 5 to 12 carbon atoms, or more preferably from about 6 to about 9 carbon atoms. Naphthas, or petroleum fractions boiling within the range of from about 80° F. to about 450° F., and preferably from about 125° F. to about 375° F., contain hydrocarbons of carbon numbers within these ranges. Typical fractions thus usually contain from about 15 to about 80 vol. % paraffins, both normal and branched, which fall in the range of about $C_5$ to $C_{12}$, from about 10 to 80 vol. % of naphthenes falling within the range of from about $C_6$ to $C_{12}$.

The reforming runs are initiated by adjusting the hydrogen and feed rates, and the temperature and pressure to operating conditions. The run is continued at optimum reforming conditions by adjustment of the major process variables, within the ranges described below:

| Major Operating Variables | Typical Process Conditions | Preferred Process Conditions |
|---|---|---|
| Pressure, Psig | 50–750 | 100–400 |
| Reactor Temp., °F. | 800–1200 | 800–1000 |
| Recycle Gas Rate, SCF/B | 1000–10,000 | 1500–4000 |

-continued

| Major Operating Variables | Typical Process Conditions | Preferred Process Conditions |
|---|---|---|
| Feed Rate, W/Hr/W | 0.5–10 | 1.0–5 |

It is apparent that various modifications and changes can be made without departing from the spirit and scope of the present invention.

Having described the invention, what is claimed is:

1. In a process for reforming a naphtha, with hydrogen, in a reforming unit which is a net producer of hydrogen, at least a portion of which is used in a Hydrofiner for hydrodesulfurizing the naphtha feed used in the reforming process, comprised of a plurality of serially connected reactors, inclusive of a lead reactor which contains a platinum catalyst and one or more subsequent reactors of the series which contains a sulfur sensitive metal promoted platinum catalyst, such that naphtha and hydrogen can be contacted with the platinum catalyst of the lead reactor at reforming conditions and the product of said reaction, and the products of subsequent reactions, passed in seratim from one reactor of the series to the next, the product of the final reactor of the series being separated into a hydrogen rich gaseous product and a $C_5+$ liquid product with a portion of the gas being recycled to the lead reactor and another portion of the gas to said Hydrofiner, the improvement comprising bypassing reactors subsequent to said lead reactor during start-up of the reforming unit with the product of said lead reactor, separating the product of said lead reactor into hydrogen-containing gaseous portions, one of which is fed to said Hydrofiner, and another of which is recycled to said lead reactor, and passing the product of said lead reactor, after line out of said reforming unit and satisfactory operation of said Hydrofiner in hydrodesulfurizing said naphtha feed to said lead reactor, in seratim from one subsequent reactor of the series to another to produce in the final reactor of the series a high octane $C_5+$ liquid product, and hydrogen.

2. The process of claim 1 wherein the catalyst contained in the lead reactor is platinum supported on alumina.

3. The process of claim 1 wherein the catalyst contained in reactors subsequent to the lead reactor is platinum promoted with rhenium.

4. The process of claim 1 wherein reactors susbsequent to the lead reactor contains platinum-rhenium catalysts, and the atomic ratio of rhenium:platinum in the catalyst of the final reactor of the series ranges at least about 1.5:1 to about 4:1, and higher.

5. The process of claim 4 wherein the atomic ratio of rhenium:platinum in the catalyst of the final reactor ranges from about 2:1 to about 3:1.

6. The process of claim 4 wherein the atomic ratio of rhenium:platinum in reactors other than the lead reactor and final reactor of the series ranges from about 0.1:1 to about 1:1.

7. The process of claim 1 wherein the catalyst of the reactors contains from about 0.01 to about 3 percent platinum.

8. The process of claim 1 wherein the catalyst of the reactors subsequent to the lead reactor in the series contains from about 0.01 to about 3 percent rhenium.

9. The process of claim 1 wherein the catalyst of the reactors contains from about 0.05 to about 1 percent platinum.

10. The process of claim 1 wherein the catalyst of the reactors subsequent to the lead reactor contains from about 0.05 to about 1 percent rhenium.

* * * * *